US008398409B2

(12) United States Patent
Schmidt

(10) Patent No.: US 8,398,409 B2
(45) Date of Patent: Mar. 19, 2013

(54) APPARATUS FOR PRODUCING A CONNECTION

(75) Inventor: Siegfried Schmidt, Koenigsbronn (DE)

(73) Assignee: Rosenberger Hochfrequenztechnik GmbH & Co KG, Fridolfing (DE)

( * ) Notice: Subject to any disclaimer, the term of this patent is extended or adjusted under 35 U.S.C. 154(b) by 93 days.

(21) Appl. No.: 12/737,696

(22) PCT Filed: Aug. 11, 2009

(86) PCT No.: PCT/EP2009/005807

§ 371 (c)(1),
(2), (4) Date: Feb. 9, 2011

(87) PCT Pub. No.: WO2010/017951

PCT Pub. Date: Feb. 18, 2010

(65) Prior Publication Data

US 2011/0159705 A1 Jun. 30, 2011

(30) Foreign Application Priority Data

Aug. 12, 2008 (DE) ..... 10 2008 038 649

(51) Int. Cl.
*H01R 13/60* (2006.01)

(52) U.S. Cl. ..... 439/39

(58) Field of Classification Search ..... 439/38–39, 439/153, 923, 188
See application file for complete search history.

(56) References Cited

U.S. PATENT DOCUMENTS

| | | | | |
|---|---|---|---|---|
| 3,521,216 | A | 7/1970 | Tolegian | |
| 3,808,577 | A | 4/1974 | Mathauser | |
| 5,401,175 | A | 3/1995 | Guimond | |
| 6,030,229 | A * | 2/2000 | Tsutsui | 439/39 |
| 6,464,509 | B1 * | 10/2002 | Emberty et al. | 439/39 |
| 6,561,815 | B1 * | 5/2003 | Schmidt | 439/38 |
| 6,565,363 | B2 * | 5/2003 | Downing | 439/39 |
| 7,066,739 | B2 * | 6/2006 | McLeish | 439/39 |
| 7,264,479 | B1 | 9/2007 | Lee | |
| 7,344,380 | B2 * | 3/2008 | Neidlein et al. | 439/39 |
| 7,625,213 | B1 * | 12/2009 | Tse | 439/39 |
| 7,828,556 | B2 * | 11/2010 | Rodrigues | 439/38 |
| 7,931,472 | B2 * | 4/2011 | David et al. | 439/39 |
| 7,963,774 | B2 * | 6/2011 | Shiff et al. | 439/38 |
| 2006/0051981 | A1 | 3/2006 | Neidlein et al. | |
| 2007/0072443 | A1 | 3/2007 | Rohrbach | |

FOREIGN PATENT DOCUMENTS

| | | |
|---|---|---|
| DE | 102008038649.9 | 1/2006 |
| DE | 202008013600 | 1/2009 |
| EP | 1194983 | 9/2003 |
| EP | 1537632 B1 | 1/2006 |
| EP | 1865581 A2 | 12/2007 |
| WO | WO 2004/027937 | 4/2004 |
| WO | WO 2010/017951 | 2/2010 |

* cited by examiner

*Primary Examiner* — Jean F Duverne
(74) *Attorney, Agent, or Firm* — Paine Hamblen, LLP

(57) ABSTRACT

An apparatus for producing a connection between an electric or electronic appliance and a cable is described and which includes magnetic elements which produce both a holding force, and at the same time, provide approximate guidance, and exact centering so as to reliably avoid electric shorts and insure correct contact-making, between the electric or electronic appliance and the cable.

13 Claims, 2 Drawing Sheets

APPARATUS FOR PRODUCING A CONNECTION

RELATED PATENT DATA

The present application claims priority from German Application No. 10 2008 038649.9, and which was filed on Aug. 12, 2008; and PCT Application Serial No. PCT/EP2009/005807, and which was filed on Aug. 11, 2009.

The invention relates to an apparatus for producing a connection between an electric or electronic appliance 5 and a cable which can be connected to the appliance or a further electric or electronic appliance.

EP 1 537 632 B1 discloses a method and a connecting apparatus for producing an electrical connection for modules or assemblies. In this case, an electrical connection is produced between a current transmitter unit, which is provided with electrical contact elements and with magnet bodies, and a current receiver unit, which is provided with electrical mating contact elements and with magnet bodies. To this end, a first step involves approximate guidance being produced by means of a mechanical connection with outsize play between connecting elements. The exact positioning and centering with precision guidance is produced in the second step by the magnetic forces of attraction and orientation between the magnet bodies of the current transmitter unit and the magnet bodies of the current receiver unit.

This connecting apparatus is intended to be used to achieve facilitation of assembly when producing proper connections, specifically particularly in the case of installation spaces which are difficult to access or which are small. The previously known invention ensures that a reliable and permanent connection is produced by means of magnetic positioning and centering between two portions which are to be connected to one another.

US 2007/0072443 A1 proposes a connecting apparatus for connecting cables for electric appliances, particularly for supplying power for laptops, wherein instead of the known plug-in connections based on the prior art with long pins only relatively short pegs or pins are used which are inserted into depressions in the appliance which is intended to be connected thereto. This measure prevents damage as a result of oblique angles when connecting the connector to the mating contact device, because the connection can be broken more easily. At the same time, it is possible to prevent displacements or even projection of the appliance from a table, a desk or the like, for example if somebody stumbles over the cable which is connected firstly to the appliance to be charged and secondly to a socket. In such a case, the connection to the appliance to be charged is broken as soon as the magnetic holding forces are exceeded. The production of a connection per se and the centering of the portions and contacts which are to be connected to one another relative to one another are effected by the shaping of the housing with a collar which contains magnet bodies. The magnetic forces of the magnet bodies bring about a holding force of a particular magnitude.

U.S. Pat. No. 7,264,479 B1 describes a connecting apparatus for connecting two coaxial cables to one another, wherein the holding forces between two connector or adapter portions are formed by means of magnetic forces. The mutually facing end faces of the two adapter portions are each provided with disks or plates for grounding. For this reason, connection requires an operator to orient the two adapter portions to one another as appropriate in advance so that connection becomes possible before the magnetic forces act and the peg-shaped contact elements can latch into the annular mating contact elements.

The present invention is based on the object of improving an apparatus of the type mentioned at the outset such that not only do magnet elements produce a holding force but also, at the same time, orientation with mechanical approximate guidance and subsequent exact centering and positioning by precision guidance are achieved by means of the magnet elements, specifically without the user needing to ensure that the portions to be connected to one another are oriented to one another exactly by the user so as to reliably avoid any shorts as a result of incorrect contact-making.

The invention achieves this object for an apparatus for producing a connection between an electric or electronic appliance and a cable which can be connected to the appliance or a further electric or electronic appliance having an adapter provided with magnet elements by means of the features cited in claim 1.

The adapter according to the invention produces a connection between the electric or electronic appliance and a further electric or electronic appliance or a cable, e.g. a charger, headphones, a microphone, a headset or a USB connecting cable, wherein the connection is made easily in a first step by means of approximate guidance by means of the at least one protrusion and the annular recess or the annular groove, for which purpose an appropriately large amount of play is provided which will generally be significantly greater than is normally provided for a conventional connection. Following the approximate guidance, the second step then involves the magnetic forces of the magnet elements being used to exactly position and center the two adapter portions relative to one another on the basis of the preceding "rough" approximation.

A fundamental advantage in this context is that the user needs to bring the two portions close to one another only "roughly", and that he does not need to ensure any correct contact-making and association between contacts, but rather that the connection is independent of rotational direction. This means that connections can also be made without any problems at locations which are difficult to access and/or when there is insufficient illumination. At the same time, this ensures that when there is too much load on the connection which might result in portions being damaged, for example, the connection is broken as soon as the magnetic holding forces are overcome by a greater force from outside.

One of the main advantages of the invention is therefore that a user no longer needs to worry whether the portions to be connected to one another are positioned correctly relative to one another in terms of current and/or data. Shorts and/or damage on the appliances to be connected to one another are thereby easily avoided without additional mechanical measures or guidance. The connection can be produced by the user more or less "blind".

A further fundamental advantage of the invention is that the lack of a mechanical connection means that no damage to plug-in contacts or plug-in pins can arise. This is the case particularly if, in accordance with the invention, the contacts are in the form of end contacts or flat contacts.

The apparatus according to the invention is particularly suitable for connecting an electric or electronic appliance to headphones or a headset. However, it goes without saying that it can also be used for laptops, computers and other electric or electronic appliances in which conventional or known plug-in connections, as for USB connectors and chargers, for example, are provided.

As a further fundamental advantage, an appliance, e.g. a laptop or computer, is prevented from being pulled down from a table, a pedestal or the like, for example, because—as already mentioned—the connection between the first adapter portion and the second adapter portion is broken after the magnetic holding forces have been exceeded. While the first adapter portion continues to have its input contacts connected to the contact elements in the appliance, the second adapter portion remains on the cable, e.g. headphones, headset or charging cable, but can subsequently be connected to the first adapter portion again without any problems. Besides damage to the appliance or the appliance being pulled down, this also prevents damage to the headphones, headset or to a socket in the case of a cable connection through a charging operation.

The same naturally also applies when two electric or electronic appliances are connected to one another for the purpose of data interchange. In each case, the adapter with the two adapter portions provides an exact predetermined breaking or detachment point.

The adapter according to the invention can be used in various ways in practice.

If appliances and cables with conventional male and female connectors, such as USB connectors and contact connections, are present, the adapter is inserted with the two adapter portions between the conventional contact elements. In this case, the first adapter portion has its input contacts connected to a first electric or electronic appliance, while the second adapter portion has its output contacts connected to the conventional connecting element of a cable or of a further appliance. The mutually facing end faces of the two adapter portions, which each have the magnet elements arranged on them, are used for electrical connection between the two adapter portions by virtue of the continuation contacts of the first adapter portion being connected to the connection contacts of the second adapter portion. As a result of the design as permanent magnets and the inventive association of the magnet poles with one another for a connection, exact centering and positioning of the adapter portions, previously connected to the respective appliances, and at the same time also the desired predetermined breaking point are produced between the continuation contacts and the connection contacts, which are connected to one another only by means of the magnetic forces of the magnet elements, following earlier approximate guidance by means of the at least one protrusion and the annular recess interacting therewith or the annular groove.

A second option for using the adapter according to the invention may be for the second adapter portion to directly replace the conventional contact connection element of a cable, which contact connection element is provided with connecting pins or female connectors. Such an embodiment is particularly suitable for connecting headphones or a headset to an electric or electronic appliance, wherein the second adapter portion according to the invention is directly connected to a connecting cable leading to the headphones or headset or is integrated in said cable.

A third option for using the adapter according to the invention may involve the first adapter portion being integrated directly in the appliance or arranged therein. In this case, the continuation contacts are connected directly to supply lines in the appliance, and the input contacts of the adapter portion can be dispensed with in this manner. The continuation contacts are then oriented and connected to the connection contacts of the second adapter portion by the magnetic forces of the magnets in the two adapter portions. In this case too, the second adapter portion can optionally replace the conventional connecting pins or female connectors of a contact connection element in a cable and be directly connected to the lines of the cable or of the second electronic appliance.

If portions which are to be connected to the electric appliance, such as headphones, microphone, headset, loudspeakers or chargers, require only few contact elements, e.g. only or three contact elements, then these can, for example, in one development of the invention, be arranged coaxially or concentrically or can be arranged in the form of concentric rings.

In this embodiment, a further simplification can be achieved such that, on one of the two adapter portions, the contact elements, e.g. the connection contacts of the second adapter portion, are in the form of punctate contacts which are arranged either centrically or eccentrically such that they interact with the contact elements of the other adapter portion, e.g. the continuation contacts of the first adapter portion, which are in centric form or are in an annular shape.

In one embodiment of the invention, provision may be made for the continuation contacts or the connection contacts to be arranged in housing depressions or at depth in a housing wall of the adapter portions. This further reduces a risk of shorting as a result of shorting of contacts.

By way of example, this embodiment makes it possible to prevent a short from occurring when, on account of the magnetic forces, a paperclip, for example, adheres to the magnets and hence to the contacts. In order to avoid this risk, depressions of between 1/10 and 5/10 mm will generally be sufficient. For a perfect contact connection, it is merely necessary in such a case for the respective mating contacts to protrude from a housing wall thereof by an appropriate amount.

For perfect contact-making, one embodiment according to the invention may have provision for the continuation contacts and/or the connection contact to be spring-loaded. This achieves contact pressure for reliable contact-making between the contacts on both sides.

As an alternative, it is also possible for the continuation contacts and/or the connection contacts to be arranged in an at least partially elastic wall. The elasticity can either extend over the entire wall in which the contacts are arranged or can extend only in sections in the regions which contain the contacts.

A further option for reliable contact-making and good contact pressure may involve the continuation contacts and/or the connection contacts abutting an at least partially elastic wall on their side which is remote from the contact side.

This measure presses each of the contacts in the direction of the contacts of the other adapter portion from the rear.

Advantageous developments could also be found in the exemplary embodiments described below with reference to the drawing, in which.

An adapter has a first adapter portion 1*a* and a second adapter portion 1*b*. The adapter portion 1*a* is provided for the purpose of connection to contact pins (not shown) which are located in a female connector 2 on an electric or electronic appliance 3. To this end, the first adapter portion 1*a* is provided with contact elements 4 and 5 (see FIG. 3) which can be connected to the contact pins in the appliance. If the contact connections in the appliance 3 are in the form of contact pins, the contact elements 4 and 5 are accordingly located in holes in the adapter portion 1*a*. If, conversely, the contact connections in the appliance 3 are arranged in holes, the adapter portion 1*a* is accordingly provided with contact pins.

Figure 1:
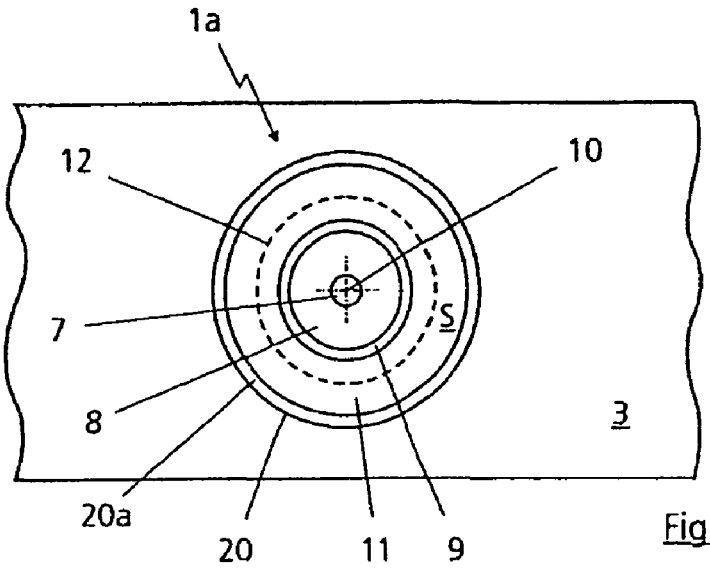
FIG. 1 shows an inventive adapter having a first adapter portion which is inserted or integrated in an electric appliance.
Figure 3:
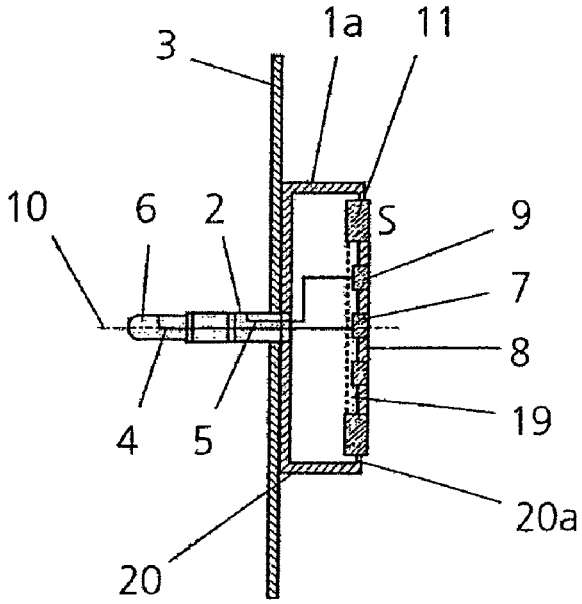
FIG. 3 shows a cross section through the first adapter portion.

FIG. 1 shows a plan view of the adapter portion 1*a*. In this case, the adapter portion 1*a* may be a separate portion which, as shown in FIG. 3, has its side which faces the appliance 3 provided with a jack connector 6 which is inserted in a conventional female connector in the appliance 3. In this case, the portion protruding from the appliance forms the adapter portion 1*a* for connection to the adapter portion 1*b*.

FIG. 1 shows an illustration in which the adapter portion 1*a* with the contacts and the arrangement of said adapter portion, described in more detail below, is integrated in the appliance itself.

That side of the adapter portion 1*a* which is remote from the appliance 3 has a continuation contact 7, e.g. in the form of a negative pole, situated centrally in the center thereof and a second continuation contact 9, in the form of an annular contact, arranged at a distance therefrom and isolated by an insulating element, e.g. a plastic ring 8, concentrically with respect to the longitudinal axis 10 of the adapter. The continuation contact 9 is adjoined by a further ring which is in the form of a magnet element 11 and, for example, has a south pole on the outwardly directed side. The adapter portion 1*a* is sealed on the outside by a housing in a plastic shroud 20 which is provided with an annular recess 20*a*, above which the magnet element 11 protrudes (see FIG. 3), on that end face which is directed toward the adapter portion 1*b*.

If the central continuation contact 7 is in the form of a positive pole, the continuation contact 9 is a negative pole therefor.

Should a third contact be necessary, a further continuation contact 12 is additionally provided in annular form on the outwardly directed side of the adapter portion 1*a* (see dashed illustration in FIG. 1).

Figure 2:
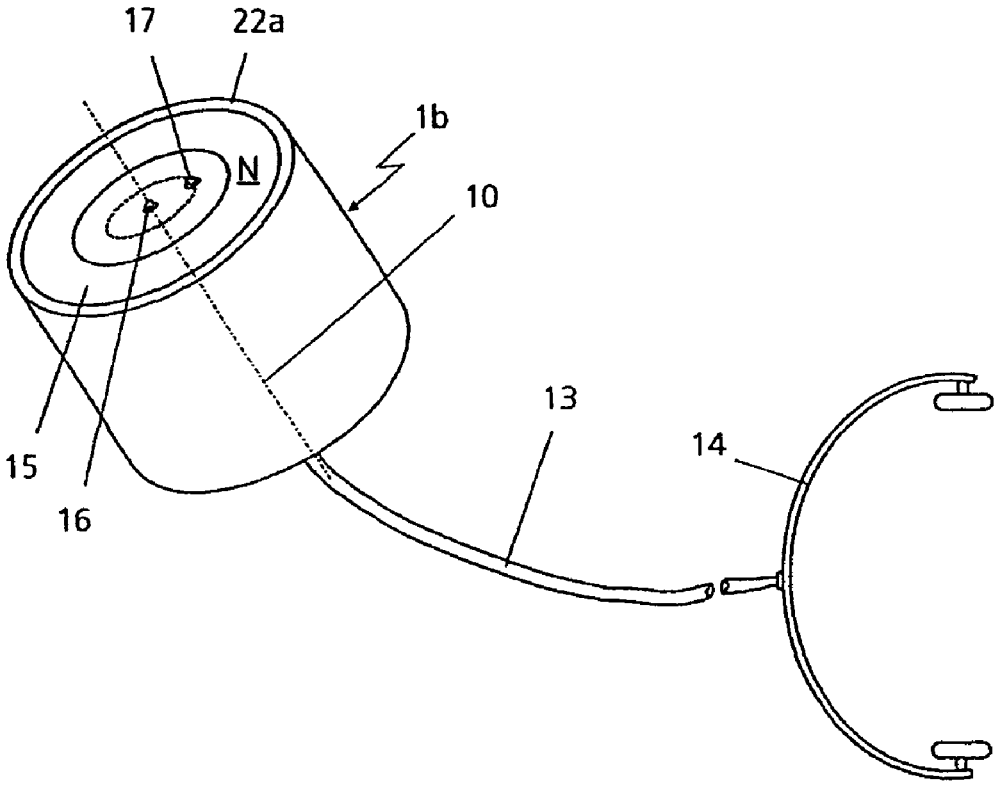
FIG. 2 shows the second adapter portion of the inventive adapter, which is permanently connected to a cable.
Figure 4:
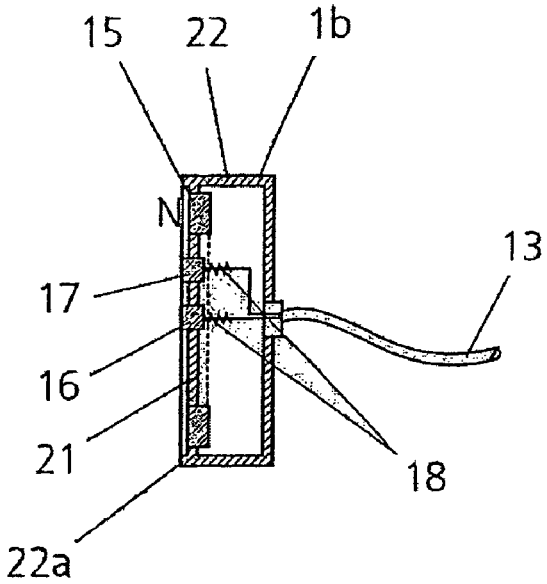
FIG. 4 shows a cross section through the second adapter portion.

In line with the exemplary embodiment shown in FIG. 2 and FIG. 4, the second adapter portion 1*b* is the terminating portion of a cable or line connection 13 to headphones 14. As can be seen from FIG. 2, a magnet element 15 of the adapter portion 1*b* is likewise arranged concentrically with respect to the longitudinal axis 10 of the circular adapter portion in an annular shape. The distance or radius of the annular magnet element 15 from the center corresponds to the distance of the magnet element 11 of the first adapter portion 1*a*. If the magnet element 11 has a south pole, the magnet element 15 is in the form of a north pole therefor.

A connection contact 16 is centric and hence at the center in the same way as the continuation contact 7 of the first adapter portion 1*a*.

The second connection contact 17 is situated as an essentially punctate contact element having a flat, slightly convex or curved surface at a distance from the center of the second adapter portion 1*b*. However, the distance or the eccentricity is chosen such that when the second adapter portion 1*b* is connected to the first adapter portion 1*a* there is contact made with the continuation contact 9 in an annular shape. This means that the distance of the connection contact 17 from the center corresponds to the radius for the ring of the continuation contact 9.

The adapter portion 1*b* is likewise provided with a housing in a plastic shroud 22 which has an annular protrusion 22*a* with respect to the end face on the end face which is directed toward the adapter portion 1*a* (see FIG. 4).

When the two adapter portions 1*a* and 1*b* are connected to one another, the different polarity of the two magnet elements 11 and 15 means that, following the approximate guidance on the basis of said magnet elements, the two adapter portions are magnetically oriented and attracted and hence exactly positioned and centered relative to one another.

For the mechanical approximate guidance, it is not absolutely necessary for the protrusion 22*a* to be in annular form. If required, individual, e.g. peg-like protrusions in a distributed arrangement over the perimeter are also sufficient, said protrusions being inserted with an appropriately large amount of play into the annular protrusion 20*a* or an annular groove made in the end face of the adapter portion 1*a*.

On the basis of the embodiment of the magnet elements 11 and 15 in an annular shape, the centric arrangement of a continuation contact 7 and of the connection contact 16 and the annular shape of the continuation contact 9 and of the connection contact 17, the two adapter portions can be connected independently of the rotational direction from one another, because the eccentric connection contact 17 is always "somewhere" on the ring of the continuation contact 9.

If a third continuation contact 12 is necessary, as shown in dashes in FIG. 1, it goes without saying that an additional connection contact likewise needs to be provided eccentrically such that it is located on the same radius as the annular continuation contact 12 shown in dashes in FIG. 1.

Instead of a third continuation contact 12 in an annular shape, it is naturally also possible to provide for the third contact to be made directly by means of the magnet elements 11 and 15. Alternatively, it is naturally also possible for the respective housings 20 and 22 of the adapter portions 1*a* and 1*b* to be used for a third contact, to which end said housings then need to be in electrically conductive form. It goes without saying that it is also possible to use both the two magnet elements and the housing portions to produce a respective additional contact, which makes even the transmission of four contacts or a corresponding data transfer possible.

To make proper contact, it is advantageous if the two punctate connection contacts 16 and 17 are spring-loaded in the second adapter portion 1*b*. This can be done by a respective spring 18 (see FIG. 4), for example, which is arranged in the adapter portion 1*b* and which respectively pretensions the associated connection contact 16 or 17 in the direction of the first adapter portion 1*a*.

Instead of punctate connection contacts 16 and 17, it goes without saying that these may also be provided as connection contacts in an annular shape. This may be the inverse of the exemplary embodiment shown, for example, which means that in this case the continuation contact 9 is provided only as a punctate contact element instead of in an annular shape.

Similarly, it is not absolutely necessary for both magnet elements 11 and 15 each to be in an annular shape. In this case too, it is possible for one of the two magnet elements to extend only partially over the perimeter.

A further solution option which is based on the same principle, namely connection independently of rotational direction, may involve both magnet elements 11 and 15 being in a centric arrangement and the continuation contacts 7 and 9 and also the connection contacts 16 and 17 each accordingly being in an annular shape, and in this case too it is again sufficient if in one of the two adapter portions the contact elements are only in the form of eccentric individual contact points, the distance between which corresponds to the radii of the contact elements of the respective other adapter portion from the center.

In the same way as the connection to headphones is described above with reference to FIGS. 1 to 4, the connection according to the invention can naturally also be made, by way of example, for connection to a microphone, headset or charger for an electric or electronic appliance, such as a laptop.

As shown in dashes by the line 19 in FIG. 3, the continuation contacts 7 and 9 may be arranged in the wall in a housing depression or somewhat at depth in comparison with the positions of the magnet elements 11 and 15. If a metal object, such as a paperclip, is attracted by a magnet element 11, for example, it still does not touch the continuation contacts 7 and 9. A depression of between 1/10 and 5/10 mm should generally be sufficient. It goes without saying that the continuation contacts 7 and 9 may also each be arranged individually in depressions in the housing wall. The housing depression 19 or the insertion into the housing wall at depth may naturally also be provided in the second adapter portion 1*b* as an alternative.

For proper contact, provision may also be made for at least one of the two outer walls of the two adapter portions 1*a* and 1*b* to be at least partially or sectionally elastic. On the basis of this elastic bearing, it is then possible to compensate for tolerances and to achieve a reliable connection between the continuation contacts 7, 9 and the connection contacts 16, 17.

Instead of the continuation contacts 7 and 9 or the connection contacts 16 and 17 being spring-loaded, provision may also be made for that side of the continuation contacts 7 and 9 or the connection contacts 16 and 17 which is remote from the contact face or contact side to abut an elastic wall 21 (see dashed illustration in FIG. 4 for adapter portion 1*b*, for example), wherein the elastic wall 21 exerts a force on the connection contacts 16 and 17 in the direction of the continuation contacts 7 and 9 of the adapter portion 1*a*. This produces reliable and stable contact between the continuation contacts 7 and 9 and the connection contacts 16 and 17. When the elastic wall 21 is arranged in the adapter portion 1*a*, the same effect is naturally achieved.

The two adapter portions 1*a* and 1*b* are used to produce both exact centering and positioning which are independent of rotational direction and a connection which can easily be broken in the event of overload. This is because the connection between the two adapter portions 1*a* and 1*b* is made merely by means of the magnetic forces of the magnet elements 11 and 15. The desired exact positioning and orientation and hence avoidance of incorrect contact connections are achieved by virtue of the magnet elements 11 and 15 being arranged as permanent magnets in a particular polarity with respect to one another. This means that, for example, the magnet element 11 forms a south pole and the magnet element 15 forms a north pole.

What I claim is:

1. An apparatus for producing an electrical connection comprising: a first adapter portion and a second adapter portion, and wherein the first adapter portion is provided with first and second continuation contacts and with a first annular shaped magnet element and which is coupled to an appliance or can be connected to the connection in the appliance, and wherein the second adapter portion is coupled to at least one cable and is provided with first and second connection contacts and with a second, annular shaped magnet element, and wherein the second adapter portion can be connected to the continuation contacts and to the first magnet element of the first adapter portion, and wherein the first magnet element in the first adapter portion has a polarity opposite to the second magnet element in the second adapter portion, and wherein the continuation contacts of the second adapter portion, the connection contacts of the first adapter portion and the first and second magnet elements are arranged relative to one another such that the resulting connection between the two first and second adapter portions is completed and is independent of the rotational orientation of the first and second adapter portions, and wherein mechanical approximate guidance is provided between the two adapter portions, and wherein in one of the two adapter portions an end face of the adapter portion which faces the other adapter portion is provided with at least one annular shaped protrusion and a housing of the other adapter portion is provided with an annular shaped recess with respect to the end face thereof and wherein the annular shaped protrusion is matinely received within the annular shaped recess to effect the mechanical approximate guidance.

2. The apparatus as claimed in claim 1, wherein the second adapter portion is connected to headphones or a headset by means of the cable.

3. The apparatus as claimed in claim 1, wherein the continuation contacts, the connection contacts and the magnet elements are arranged coaxially or concentrically or are situated on concentric rings.

4. The apparatus as claimed in claim 1, wherein the continuation contacts and/or the connection contacts are arranged on the adapter portions centrally or in an annular shape.

5. The apparatus as claimed in claim 4, wherein the continuation contacts or the connection contacts are in the form of at least approximately punctuate contacts which are arranged either centrically or eccentrically such that they interact with the contact elements of the other adapter portion, which are in centric form or in an annular shape.

6. The apparatus as claimed in claim 1, wherein the continuation contacts and the connection contacts are at least approximately in the form of end contacts and/or flat contacts.

7. The apparatus as claimed in claim 6, wherein the continuation contacts or the connection contacts are arranged in a housing depression, or at a depth in a housing wall.

8. The apparatus as claimed in claim 7, wherein the depression is between 1/10 and 5/10 mm in depth.

9. The apparatus as claimed in claim 1, wherein the continuation contact and/or connection contacts are spring-loaded.

10. The apparatus as claimed in claim 1, wherein the cable has headphones, a microphone, a headset, a loudspeaker or a charger connected to it.

11. The apparatus as claimed in claim 1, and wherein the continuation contacts and/or the connection contacts abut an at least partially elastic wall on the side which is remote from the contact side.

12. The apparatus as claimed in claim 1, wherein the continuation contacts and/or the connection contacts are arranged in an at least partially elastic wall.

13. An apparatus for producing an electrical connection, comprising:

a first adapter portion which is electrically coupled to an electrically energized appliance, and wherein the first adapter portion has a housing which is defined by a peripheral wall, and which further defines an end face which has formed therein an annular shaped recess which is located adjacent to the peripheral wall of the housing; a first, annularly shaped magnet having a predetermined polarity, and which is mounted on the end face of the first adapter portion, and wherein the first, annularly shaped magnet has an outside facing surface which protrudes outwardly from the end face, and which further is located radially, inwardly relative to the annular shaped recess; a first, continuation contact having a predetermined polarity, and which is positioned substantially centrally of the end face, and which is further located in spaced relation relative to the first, annularly shaped magnet; a first, annularly shaped electrically insulative element which is positioned adjacent, and radially, outwardly relative to the first, continuation contact; a second, annularly shaped, continuation contact having a polarity opposite to the first, continuation contact, and which further is located adjacent, and radially, outwardly relative to, the first, annularly shaped electrically insulative element; a second, annularly shaped electrically insulative element which is located adjacent, and radially outwardly relative to, the second, annularly shaped continuation contact, and which is further located adjacent, and radially inwardly relative to the first, annularly shaped magnet; and a second adapter portion which is electrically coupled to an electrical conduit, and which has a housing which is defined by a peripheral wall, and wherein the peripheral wall defines a protrusion which is dimensioned to matingly cooperate, and be received within, the annular shaped recess which is defined by the end wall of the first adapter portion, and wherein the second adapter portion has an end face which is located inwardly relative to the protrusion and which is defined by the peripheral wall of the second adapter portion; a second, annularly shaped magnet having a polarity which is opposite to the polarity of the first annularly shaped magnet, and which is borne by the first, adapter portion, and wherein the second, annularly shaped magnet is located adjacent, and radially inwardly relative to, the peripheral wall of the second adapter portion; a first, spring biased, punctuate, connection contact which is located substantially centrally relative to the housing, and which is borne by the end wall of the second adapter portion, and which is further electrically isolated from the second, annularly shaped magnet, and wherein the first, spring biased, punctuate, connection contact makes electrical contact with the first, continuation contact when the first and second adapter portions are releasably, matingly coupled together;

and a second, spring biased, punctuate, connection contact which is borne by the end wall of the second adapter portion, and wherein the second, spring biased, punctuate, connection contact is electrically isolated from the first, spring biased, punctuate, connection contact, and the second, annularly shaped magnet, and wherein the second, spring biased, punctuate, connection contact is located radially, outwardly relative to the first, spring biased, punctuate connection contact, and at a predetermined distance, so as to facilitate the second, spring biased, punctuate, connection contact making electrical contact with the second, annularly shaped continuation contact which is borne by the first adapter portion when the first and second adapter portions are releasably, matingly coupled, and then held together by the mutual magnetic attraction of the first and second annularly shaped magnets, and wherein the mating receipt of the protrusion defined by the second, adapter portion, and within the recess defined by the first adapter portion, provides mechanical, approximate guidance for aligning the first and second adapter portions, and wherein the electrical coupling of the first and second adapter portions is successfully made regardless of the relative rotational orientation of the first and second adapter portions after approximate alignment of the first and second adapter portions has been achieved.

* * * * *

UNITED STATES PATENT AND TRADEMARK OFFICE

CERTIFICATE OF CORRECTION

PATENT NO. : 8,398,409 B2
APPLICATION NO. : 12/737696
DATED : March 19, 2013
INVENTOR(S) : Siegfried Schmidt It is certified that error appears in the above-identified patent and that said Letters Patent is hereby corrected as shown below:

In the Claims

Claim 1, line 1, replace “matinely” with --matingly--.

Signed and Sealed this
Twenty-fifth Day of June, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,398,409 B2
APPLICATION NO. : 12/737696
DATED : March 19, 2013
INVENTOR(S) : Siegfried Schmidt It is certified that error appears in the above-identified patent and that said Letters Patent is hereby corrected as shown below:

In the Claims

Column 7, line 41 (Claim 1, line 1) replace “matinely” with --matingly--.

This certificate supersedes the Certificate of Correction issued June 25, 2013.

Signed and Sealed this
Twenty-third Day of July, 2013

Teresa Stanek Rea
*Acting Director of the United States Patent and Trademark Office*